US005385495A

United States Patent [19]

Henns

[11] Patent Number: 5,385,495

[45] Date of Patent: Jan. 31, 1995

[54] SELF ADJUSTING WATER SKI ASSEMBLY

[76] Inventor: John A. Henns, 4611 Sloewood Dr., Tangerine, Fla. 32777

[21] Appl. No.: 45,551

[22] Filed: Apr. 8, 1993

[51] Int. Cl.[6] ..... B63B 35/81

[52] U.S. Cl. ..... 441/79; 114/127

[58] Field of Search ..... 114/127, 140, 162, 167, 114/280, 275; 441/68, 79

[56] References Cited

U.S. PATENT DOCUMENTS

| | | | |
|---|---|---|---|
| 2,967,503 | 1/1961 | Unger | 114/280 |
| 3,001,502 | 9/1961 | Stoker | 114/167 |
| 3,120,829 | 2/1964 | Chew et al. | 114/162 |
| 3,225,728 | 12/1965 | Nomura et al. | 114/275 |
| 4,037,279 | 7/1977 | Ziebart | 9/310 A |
| 4,439,166 | 3/1984 | Maxwell | 441/79 |
| 4,775,344 | 10/1988 | Anderson | 441/68 |
| 5,057,045 | 10/1991 | Myers | 441/79 |

*Primary Examiner*—Sherman Basinger
*Attorney, Agent, or Firm*—Steven C. Stewart

[57] ABSTRACT

A water ski fin extends through the rear of a water ski. Pivotally connected to a lower portion of the fin is a wing extending substantially perpendicularly from the fin. A device is connected to the wing that allows the wing to pivot and change its angle of attack as a function of the speed of the fin through the water.

7 Claims, 3 Drawing Sheets

SELF ADJUSTING WATER SKI ASSEMBLY

BACKGROUND OF THE INVENTION

This invention relates to water sports equipment and more particularly, to finned water skis for controlling the stability during operation.

Conventional water skis include a fin or rudder mounted to the rear on surface portions of the ski. These fins make it easier for the skier to control his skis.

It has been found that slippage of the rear fin can be reduced by providing horizontally extending wings that extend outward from this fin. These wings can act as breaks to help maintain precise control of the ski. Two wings are typically mounted on the fins at fixed angles.

Angular positions can significantly effect the performance of the skis. Examples of a fin having a fixed manually adjustable angular position is disclosed in U.S. Pat. No. 4,439,166, which is hereby incorporated by reference.

Ideally, it is desirable to maintain a variable angle of the wing with respect to the speed of water past the wing. A wing at a fixed angle can cause unwanted drag and a degradation of ski performance as the speed of the ski increases.

SUMMARY OF THE INVENTION

An object of this invention is to provide an improved water ski fin.

Another object of this invention is to increase the performance of the ski by changing the angle of the fin with respect to changes in the velocity of water.

These and other objects are provided with a self adjusting water ski assembly. The assembly includes a water ski with a substantially planer lower surface and a fin connected to the ski and extending substantially perpendicularly away from the skis lower surface. A wing is pivotally connected to the fin and extended substantially perpendicularly outward from either side of the fin. The wing also has a substantially planer surface. A device is connected to the wing that changes the angle between the planer lower surface of the ski and the planer surface of the wing as a function of the velocity of the fin through the water. By changing the angle as a function of the velocity of the water, better control, stability, acceleration and braking of the water ski may be obtained.

DESCRIPTION OF THE PREFERRED EMBODIMENTS

Figure 1:
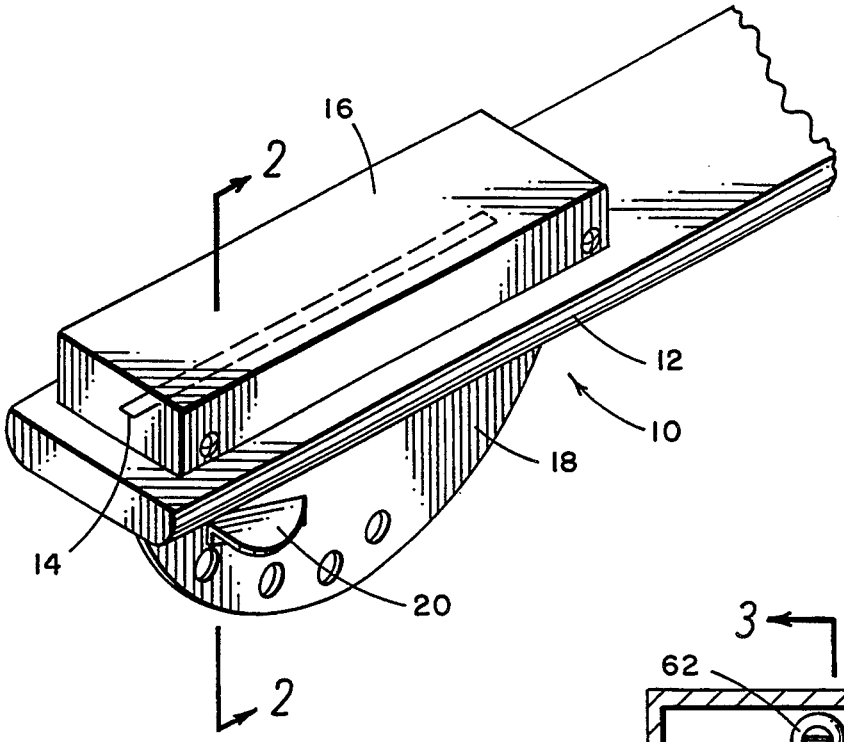
FIG. 1 is a perspective view of the invention mounted on a rear portion of a water ski.

Referring now to the drawings and detail where in like reference numerals have been used throughout the various figures to designate like elements, there is shown in FIG. 1 a water ski fin having an adjustable wing constructed in accordance with the principles of the present invention designated generally as 10. The device 10 is shown mounted on rear end of ski 12. The ski includes an elongated slot 14 therein which passes entirely through the ski adjacent to center line thereof. The ski 12 is, per se, conventional. According only in a portion thereof has been shown in the drawings.

The device 10 is comprised essentially of three principle parts; a housing or mounting means 16, a fin 18 and wings 20 and 21. As shown and more clearly in FIGS. 2–4, the entire housing or mounting means 16 is located on the upper surface of ski 12. The fin extends downwardly through slot 14 perpendicular to housing 16 and ski 12. Wings 20 and 21 extend perpendicularly outward from the surface of fin 18 and extend on either side thereof.

Within mounting means is a pair of L-shaped brackets 19 and 22, which connect with screws 26, 27 and 28 through brackets 19 and 22 and are held in place with nuts 30–32, respectively. The fin 18 is sandwiched between brackets 19 and 22 and is held in place by turning screws 26–28.

Figure 2:
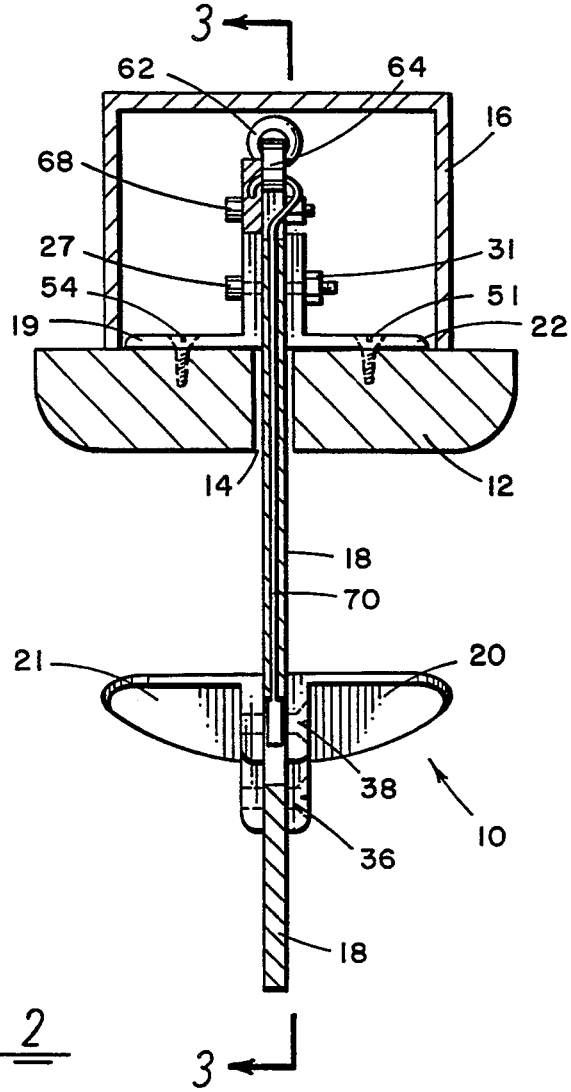
FIG. 2 is a rear view of the invention along line 2—2 of FIG. 1.
Figure 3:
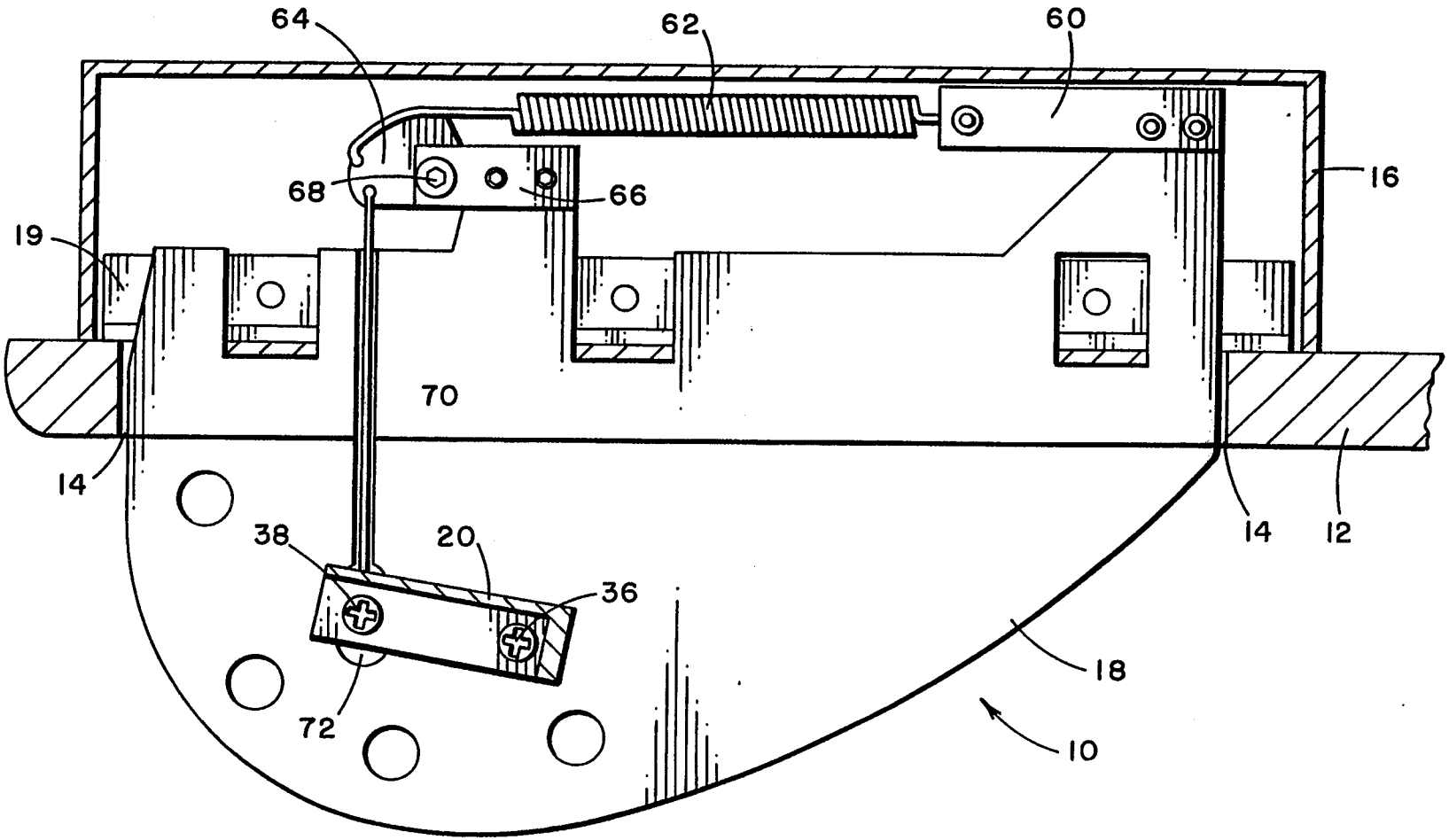
FIG. 3 is a side view of the invention along line 3—3 of FIG. 2.
Figure 4:
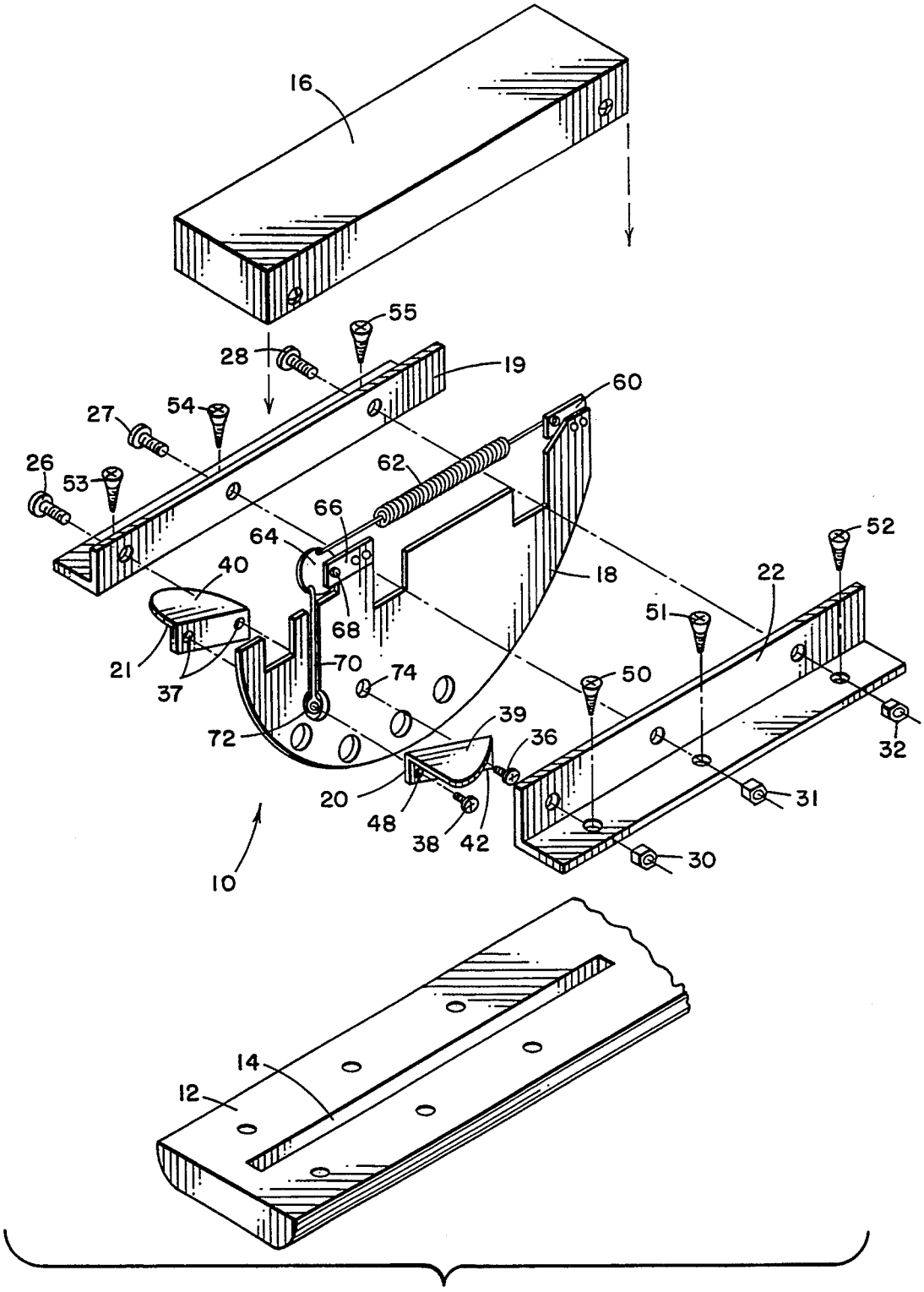
FIG. 4 is an exploded view of the invention shown in FIG. 1.

Referring to FIGS. 2–4, right wing 20 and left wing 21 are pivotally connected with pivot or screw 36 to a substantially lower center portion of fin 18. Wings 20 and 21 are preferably L-shaped brackets having a planer flat surface 39 and 40, respectively. Wing 20 has an aperture 42 through which pin or screw 36 is inserted and an aperture 48 through which screw 38 is inserted therethrough. Screws 36 and 38, respectively, extend through fin 18 and attach through a threaded apertures 37 in wing 21. Brackets 19 and 22 are connected with screws 50–55 to the top surface of ski 12.

Connected to a forward top edge of fin 18 is plate 60. Plate 60 is connected through spring 62 to rotating cam 64. Although spring 62 is shown, any tension device may be used. Rotating cam 64 is pivotally connected to a center portion of a bracket 66 and maintained on a center position of fin 18 with pin 68. Extending downward from cam 64 is rod 70 that is connected at one end to cam 64 and extends within an aperture 72 disposed rearward on fin 18 from aperture 74. Rod 70 end is shaped like an eyelet such that screw 38 extends therethrough allowing wings 20 and 21 to pivot about screw 36 on fin 18.

During operation of the fin 18, at slow speeds spring 62 is in a contracted position forcing the angle of the top surface of wings 20 and 21 to be at about a 20° angle with respect to the bottom surface of ski 12. As the velocity of the ski through the water increases and decreases, water is directed by ski 12 over wings 20 and 21 forcing spring 62 to expand and contract and the angle of wings 20 and 21 to change with respect to horizontal. This creates a variable rearward drag force that is a function of the wing angle, spring force, and water velocity. This variable drag creates enhanced ski performance and control.

Preferred angle at which wings 20 and 21 rotates about screw 36 is between 0°–20° although other angles may be applicable, depending on the application and use of the skier. By using cam 64, the amount that wings 20 and 21 rotate with respect to the water velocity may be linear as a function of the speed or may be non-linear depending on the curvature of cam 64. Accordingly, it may require a large increase in velocity to effect the angle of the surface of wings 20 and 21 with respect to the bottom surface of ski 12.

This concludes the description of the preferred embodiments. A reading by those skilled in the art will bring to mind various changes without departing from the spirit and scope of the invention. It is intended, however, that the invention only be limited by the following appended claims.

What is claimed is:

1. An automatically adjusting water ski fin and wing assembly comprising;

a mounting means adapted to extend and over lie an elongated longitudinal slot in a rear portion of a water ski;

means for securing said mounting means to an upper surface of the water ski;

a fin connected to said mounting means and extending through said slot and away from a lower surface of the water ski;

a wing extending outward from either side of said fin and substantially perpendicular thereto;

a pivot pin connecting said wing to said fin; and means for rotating said wing about said pivot in response to the velocity of the fin through water changing.

2. The assembly as recited in claim 1, wherein the wing has a surface at an angle with respect to the lower surface of the ski; and wherein said rotating means changes the angle of the surface of the wing with respect to the lower surface of the water ski as a function of the fin and ski velocity through the water.

3. The assembly as recited in claim 1 wherein said rotating means includes a tension device connected through a cam, and a rod connected at one end to said cam and at its other end to said wing.

4. The apparatus as recited in claim 1, wherein said wing rotates from about 0° to about 20°.

5. A self-adjusting water ski assembly comprising:

a water ski having a substantially planer lower surface and a rear portion, said ski having an elongated longitudinal extending slot in its rear portion;

a fin connected to said ski and extending into said slot, said fin having substantially perpendicularly orientation with respect to the ski lower surface;

a wing pivotally connected to said fin and extending substantially perpendicularly outward from either side of said fin, said wing having a substantially planer surface; and means for changing the angle between the planer lower surface of the ski and the planer surface of the wing as a function of the velocity of the fin through the water.

6. The assembly as recited in claim 5, wherein said ski and said wing planer surfaces extend substantially parallel to each other when said fin velocity is high and wherein said ski and wing planer surfaces extend non-parallel with respect to each other when said fin velocity is low.

7. An automatically adjusting water ski fin and wing assembly comprising:

a left and right elongated mounting bracket having an L-shaped cross section;

a water ski having a rear portion with an elongated longitudinal slot;

a plurality of fasteners securing said mounting bracket to an upper surface of the water ski adjacent said elongated longitudinal slot, where said left bracket is secured to one side of said slot and said right bracket is secured to the other side of said slot;

a fin sandwiched between said brackets and extending through said slot perpendicularly away from a bottom surface of the ski;

a wing extending perpendicularly outward from either side of said fin;

a pivot pin connecting a front portion of said wing to said fin;

a spring connected to a top portion of the fin;

a cam pivotally coupled to a substantially mid portion of said fin and connected to said spring;

a bar extending from said cam through a slit in said fin to a rear portion of said wing; and said top surface of said wing having an angle of between 0 to about 20 degrees with respect to the bottom surface of the ski wherein said angle changes as a function of the velocity of the fin through the water.

* * * * *